US010465693B2

(12) United States Patent
Johnson

(10) Patent No.: US 10,465,693 B2
(45) Date of Patent: Nov. 5, 2019

(54) WINDMILL CEILING FAN

(71) Applicant: Quorum International, Inc., Fort Worth, TX (US)

(72) Inventor: Aaron M. Johnson, Fort Worth, TX (US)

(73) Assignee: Quorum International, Inc., Fort Worth, TX (US)

( * ) Notice: Subject to any disclaimer, the term of this patent is extended or adjusted under 35 U.S.C. 154(b) by 443 days.

(21) Appl. No.: 15/386,276

(22) Filed: Dec. 21, 2016

(65) Prior Publication Data

US 2018/0172014 A1 Jun. 21, 2018

(51) Int. Cl.

| | |
|---|---|
| ***F04D 25/08*** | (2006.01) |
| ***F04D 29/34*** | (2006.01) |
| ***F04D 29/38*** | (2006.01) |
| ***F04D 29/64*** | (2006.01) |

(52) U.S. Cl.
CPC ..... *F04D 25/088* (2013.01); *F04D 29/34* (2013.01); *F04D 29/38* (2013.01); *F04D 29/644* (2013.01)

(58) Field of Classification Search
CPC ..... F04D 25/088; F04D 29/34; F04D 29/38; F04D 29/644
USPC ..... 410/21
See application file for complete search history.

(56) References Cited

U.S. PATENT DOCUMENTS 457,168 A * 8/1891 Clair ..... F03D 1/0608 403/164
493,060 A * 3/1893 Bowman ..... F03D 7/0212 416/13
501,355 A * 7/1893 Myers ..... F03D 7/00 416/13
515,408 A * 2/1894 Putnam ..... F01D 5/24 416/196 R
523,842 A * 7/1894 Noyes ..... F01D 5/24 416/196 R
543,461 A * 7/1895 Bramwell ..... F01D 5/22 416/195
556,914 A * 3/1896 Bramwell ..... F03D 7/0212 416/12
581,613 A * 4/1897 Pippin ..... F16H 19/043 74/32
622,842 A * 4/1899 Dietz ..... F04B 9/14 74/592
716,658 A * 12/1902 Benster ..... F03D 7/0212 416/13
1,377,328 A * 5/1921 Eggerth ..... F03D 7/0224 416/53
3,085,632 A * 4/1963 Schwegler ..... F04D 29/34 416/219 R (Continued)

*Primary Examiner* — David Hamaoui
*Assistant Examiner* — John D Bailey
(74) *Attorney, Agent, or Firm* — Whitaker Chalk Swindle & Schwartz PLLC; Charles Gunter

(57) ABSTRACT

A blade mounting assembly is used to produce a completed windmill ceiling fan having fan blades that extend out from a fan motor body that rotates about a motor shaft. The blades are mounted using an inner and outer support ring. The inner support ring includes a series of blade receiving pockets. The outer support ring is initially shipped as a series of separable segments which are subsequently locked together to form the complete ring. Each of the outer ring segments also carries a gusset which receives a portion of a fan blade for further supporting the fan blade.

20 Claims, 6 Drawing Sheets

(56) References Cited

U.S. PATENT DOCUMENTS

| | | | | | |
|---|---|---|---|---|---|
| 3,332,500 | A * | 7/1967 | Bristol | F04D 29/34 | 415/217.1 |
| 4,427,342 | A * | 1/1984 | Sutz | F03D 15/10 | 416/170 R |
| 4,444,543 | A * | 4/1984 | Wilks | F03D 1/0608 | 416/170 R |
| D279,293 | S * | 6/1985 | Sutz | D15/1 | |
| 6,155,785 | A * | 12/2000 | Rechnagel | F03D 1/0608 | 416/196 A |
| 7,484,925 | B2 * | 2/2009 | Carlson | F04D 29/661 | 415/119 |
| D785,155 | S * | 4/2017 | Wang | F04D 25/088 | D23/377 |
| D816,826 | S * | 5/2018 | Johnson | D23/377 | |
| 2003/0219340 | A1 * | 11/2003 | Hidalgo | F04D 25/088 | 416/206 |
| 2004/0001758 | A1 * | 1/2004 | Liang | F04D 25/088 | 416/221 |
| 2017/0037869 | A1 * | 2/2017 | Zauhar | F04D 29/34 | |
| 2017/0284405 | A1 * | 10/2017 | Eggers | F04D 25/088 | |

* cited by examiner

WINDMILL CEILING FAN

BACKGROUND

1. Field of the Invention

The present invention relates generally to electric ceiling fans and, more specifically, to a windmill style electric ceiling fan.

2. Description of the Prior Art

Windmills have been used for centuries to convert wind power to other useful ends, such as in pumping water or in providing electrical power. In recent years, windmill ceiling fans have become increasingly popular. These fans either incorporate the components of old windmills, or are newly manufactured from new components. They add a touch of rustic Americana nostalgia to either indoor or outdoor areas. These fans present the beauty and durability of the traditional windmill, while installing like a standard ceiling fan. They make attractive interior or exterior placements using standard electrical service. Special ceiling supports are generally not required. Whether hung in a cathedral ceiling, urban loft, great room, or outdoor kitchen patio, these fans provide a pleasing esthetic centerpoint to complete any room.

Most people are familiar with the design of a traditional ceiling fan. The traditional ceiling fan will typically include a downrod suspended from the ceiling, a motor having a motor shaft connected to a lower portion of the downrod and a motor body which rotates about the motor shaft. A motor housing is secured to either the motor shaft or the downrod assembly which is stationary and surrounds the motor. Blade mounting irons connect to the motor body and extend out of a lower opening of the motor housing. The fan blades are attached to the blade irons below the motor housing.

In the case of a windmill style ceiling fan, the fan blade arrangement is much larger and more massive in size than the typical home electric ceiling fan. As a result, there is a need to securely support the fan blades about the motor body with a special blade mounting assembly.

It would also be desirable to provide a windmill style electric ceiling fan with at least part of the blade support structure being made up of component parts which allow parts of the blade support structure to be broken down for shipment.

The present invention has as its objects to address these and other shortcomings in the prior art devices presently available in the marketplace.

SUMMARY OF THE INVENTION

The blade mounting assembly of the invention is used for producing a completed electric windmill style ceiling fan where the ceiling fan has a plurality of blades formed as longitudinal planar bodies between inner and outer extents thereof. The ceiling fan further includes a ceiling fan motor with a motor body that rotates about a motor shaft. The blade mounting assembly includes a relatively smaller diameter inner support ring that, in one preferred form is made up of a plurality of ring sections. Because of its size, it can be shipped fully assembled out of its shipping box. The inner ring is secured to the motor body by a series of lower support arms. The inner support ring has a series of blade receiving pockets formed about a periphery thereof for receiving an inner extent of a fan blade to be supported in the completed assembly. A relatively larger diameter outer support ring is preferably formed as a series of separable segments which are interlockable in use to form a completed solid ring. The outer support ring is secured to the motor body by a series of upper support arms. The support arms connect to a motor arm bracket which surrounds the motor body and which rotates with the motor body. Forming the outer support ring as a series of separable segments allows the larger diameter outer support ring to be shipped disassembled as separate segments which saves space and shipping costs.

Preferably, each of the outer support ring segments includes an arcuate ring portion of a predetermined length, with a female connector at one extent and a mating male connector at an opposite extent thereof. At least selected ones of the outer ring segments carry a gusset which receives a portion of a fan blade for further supporting the fan blade. In one preferred form of the blade mounting assembly, each of the fan blades has at least one opening in the planar body between the inner and outer extents thereof with a portion of the outer support ring segments passing through the opening to further support the fan blades in the completed assembly. Each of the outer ring segments also preferably passes through an opening provided in the associated gusset which holds one of the respective fan blades in place, the opening in the gusset being alignable with a respective opening provided in the planar body of the fan blade.

In one preferred form, each of the fan blades has a peripheral edge region which defines the inner and outer extents of the planar body thereof, with each gusset comprising a sleeve having an upper surface, a lower surface, and opposing turned-in pockets. The opposing turned-in pockets each receives a portion of the peripheral edge region of a respective fan blade being supported in the completed assembly. At least selected ones of the upper support arms are connected at one end to the motor arm bracket and, in turn, to the fan motor body, and at an opposite end to the outer ring itself. Also, at least selected ones of the lower support arms are connected at one end to the motor arm bracket and, in turn, to the fan motor body, and at an opposite end to one of the series of blade receiving pockets carried on the inner ring.

The previously described blade mounting assembly can be used to assemble a completed windmill style ceiling fan. A method of the invention is also shown for completing the assembly of the windmill ceiling fan using the previously described components. The method of the invention includes the steps of:

providing an inner support ring;

securing the inner support ring to the motor body by a series of lower support arms, the inner support ring having a series of blade receiving pockets formed about a periphery thereof for receiving an inner extent of a fan blade to be supported;

providing an outer support ring formed as a series of separable segments which are interlockable in use to form a completed solid ring;

assembling the outer ring by interlocking the series of separable segments and securing the outer support ring to the motor body by a series of upper support arms; and wherein each of the outer support ring segments includes an arcuate ring portion of a predetermined length, with a female connector at one extent and a mating male connector at an opposite extent thereof, the female and mating male connectors being engaged in forming the assembled outer support ring, at least selected ones of the outer ring segments carrying a gusset which receives a portion of a fan blade for further supporting the fan blade.

The preferred method of the invention also includes the steps of:

providing each blade with at least one opening in the planar body between the inner and outer extents thereof and passing a portion of one of the respective outer support ring segments through the opening to further support the fan blades; and wherein each of the outer ring segments is also passed through an opening provided in the associated gusset which holds one of the respective fan blades in place, the opening in the gusset being alignable with a respective opening provided in the planar body of the fan blade between the inner and outer extents thereof.

In the most preferred method of the invention, at least selected ones of the upper support arms are connected at one end to the motor arm bracket and, in turn, to an upper portion of the fan motor body, and at an opposite end to the outer ring itself. At least selected ones of the lower support arms are connected at one end to the motor arm bracket and, in turn, to a lower portion of the fan motor body and at an opposite end to one of the series of blade receiving pockets carried on the inner ring.

Additional objects, features and advantages will be apparent in the written description which follows.

DETAILED DESCRIPTION OF THE INVENTION

The present invention is directed toward a method and component parts for assembling a windmill style ceiling fan. By "windmill style ceiling fan" is meant a ceiling fan which features a conventional type ceiling fan motor, but with the motor being used to support and drive a plurality of fan blades having the appearance of a traditional farm or ranch style windmill blade arrangement. In fact, some early attempts to provide windmill style ceiling fans used actual windmill heads mounted, for example, in a gable location in the ceiling, with a motor arrangement off in a side location. There have been more recent commercial versions of the windmill style ceiling fan introduced into the marketplace in recent years. All of these fans known to Applicant share a common characteristic in that they use a solid outer ring for supporting the fan blades.

One of the challenges of providing a realistic looking windmill style ceiling fan is the size of the blade arrangement and number of blades, as compared to typical electric ceiling fans available in the marketplace. An actual windmill uses a bent rod which forms a 360° support ring, with the support ring being threaded through the fan blades to support the blades in a desired pattern. There might be, for example, 18 blades with a ring having a 70 to 80 inch diameter. This presents a problem when designing a modern version of the traditional windmill blade arrangement in that the large diameter of the support ring and assembled blades would be difficult and costly to ship. It would, therefore, be advantageous to be able to break down the blade assembly in some fashion for shipment, while at the same time providing a blade assembly technique which is not overly complex or time consuming. The present invention is directed toward a blade assembly and method of assembling a windmill style ceiling fan which overcomes these and other deficiencies of the prior art.

Figure 5:
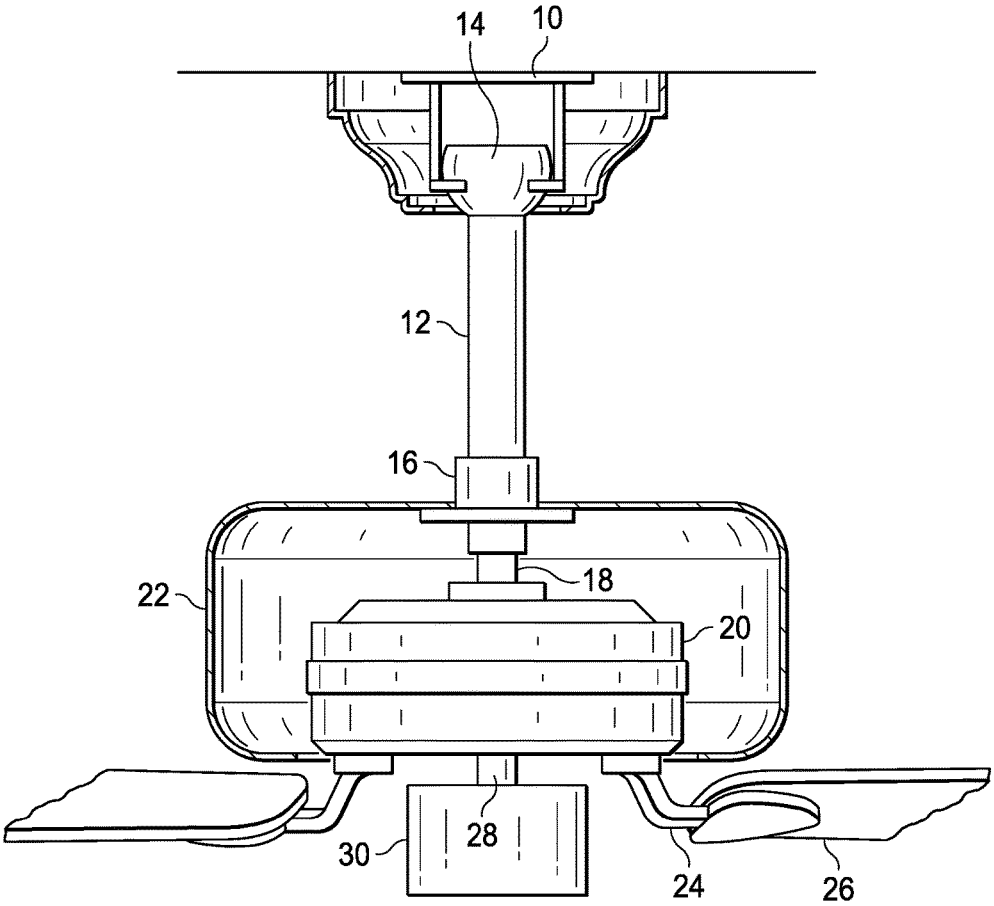
FIG. 5 (PRIOR ART)
FIG. 5 is a simplified, schematic view of a prior art traditional ceiling fan showing the operative components thereof.

In order to fully appreciate the advantages offered by the improved windmill ceiling fan design of the invention, it may be helpful to refer to FIG. 5 of the drawings which shows the principal operative components of a traditional ceiling fan (not a windmill style fan). As shown in FIG. 5, a hanger ball bracket 10 is used to suspend the assembly from the ceiling. The down rod 12 has a hanger ball 14 at one end which is received in the ball bracket 10. An opposite end of the hanger rod 12 is connected to yoke 16. The yoke is connected to an upper motor shaft 18 which connects to the motor 20. The motor 20 is received within a motor housing 22 and rotates within the housing once electrical power is supplied. A series of blade irons 24 extend from a bottom opening in the motor housing and, in turn, carry the fan blades 26. As the motor 20 rotates, the blade irons 24 and fan blades 26 also rotate. A lower shaft 28 is connected to a switch cup 30. The switch cup 30 contains one or more electrical switches used to control the basic fan functions such as on/off, fan speed, etc.

Figure 6:
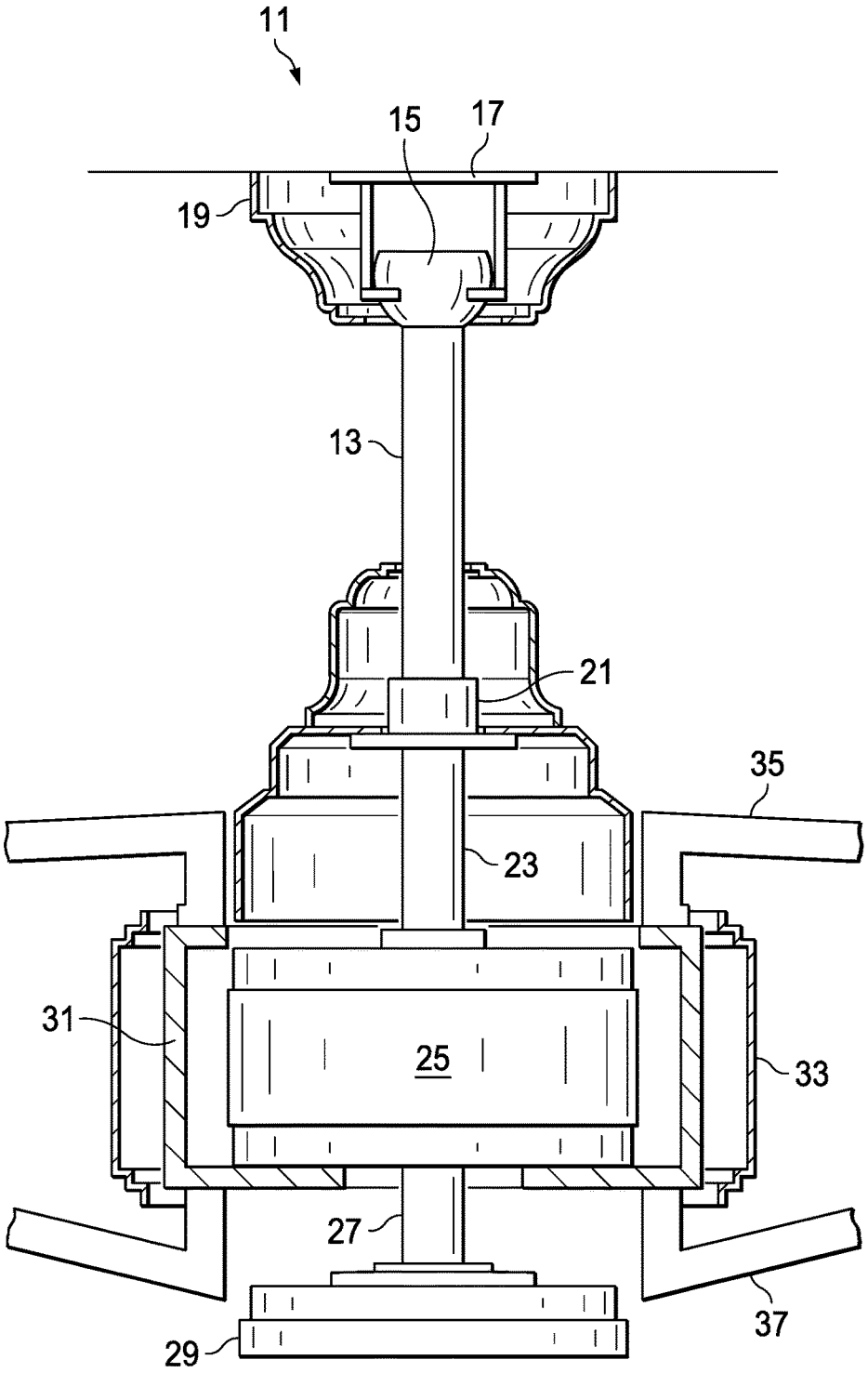
FIG. 6 is a view similar to FIG. 5, but showing the operative components of the windmill ceiling fan of the invention.

FIG. 6 is a partly schematic view, similar to FIG. 5, but of the new windmill ceiling fan of the invention. Although the windmill ceiling fan (11 in FIG. 6) shares certain operative components with the traditional ceiling fan, it also has some critical differences which will be explained in greater detail in the written description which follows. FIG. 6 shows the principal operative components of the windmill ceiling fan of the invention in simplified fashion. Once again, a hanger down rod 13 is used to suspend the assembly from the ceiling by means of a hanger ball 15. As with the traditional ceiling fan, the hanger ball is received within a hanger ball bracket 17 which is covered by canopy 19. The hanger down rod 13 connects to a yoke 21 which in, in turn, connects to an upper motor shaft 23. The upper motor shaft 23 connects to the fan motor body 25 which rotates as power is supplied to the assembly. A lower shaft 27 connects to a switch cup 29.

The motor body 25 carries motor arm brackets 31 which are, in turn, surrounded by a motor housing 33. The motor housing 33 and motor arm brackets 31 rotate as the fan motor body 25 rotates. The upper and lower support arms (35, 37 respectively) attach to the motor arm brackets 31, as will be explained in greater detail below.

Figure 1:
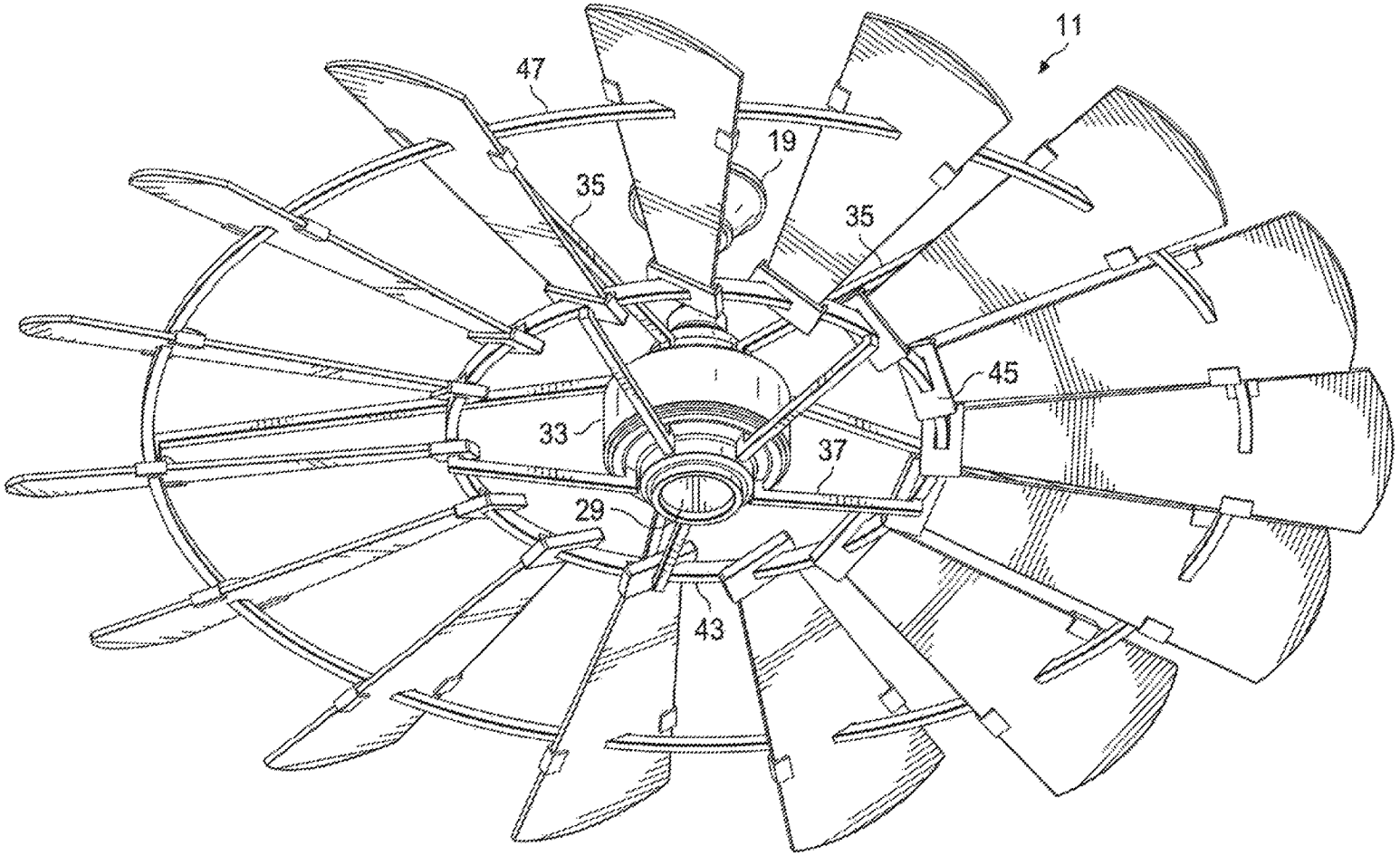
FIG. 1 is a perspective view of a windmill ceiling fan of the invention as viewed by an observer below the mounted ceiling fan, showing the inner and outer blade support rings and supported blades.
Figure 2:
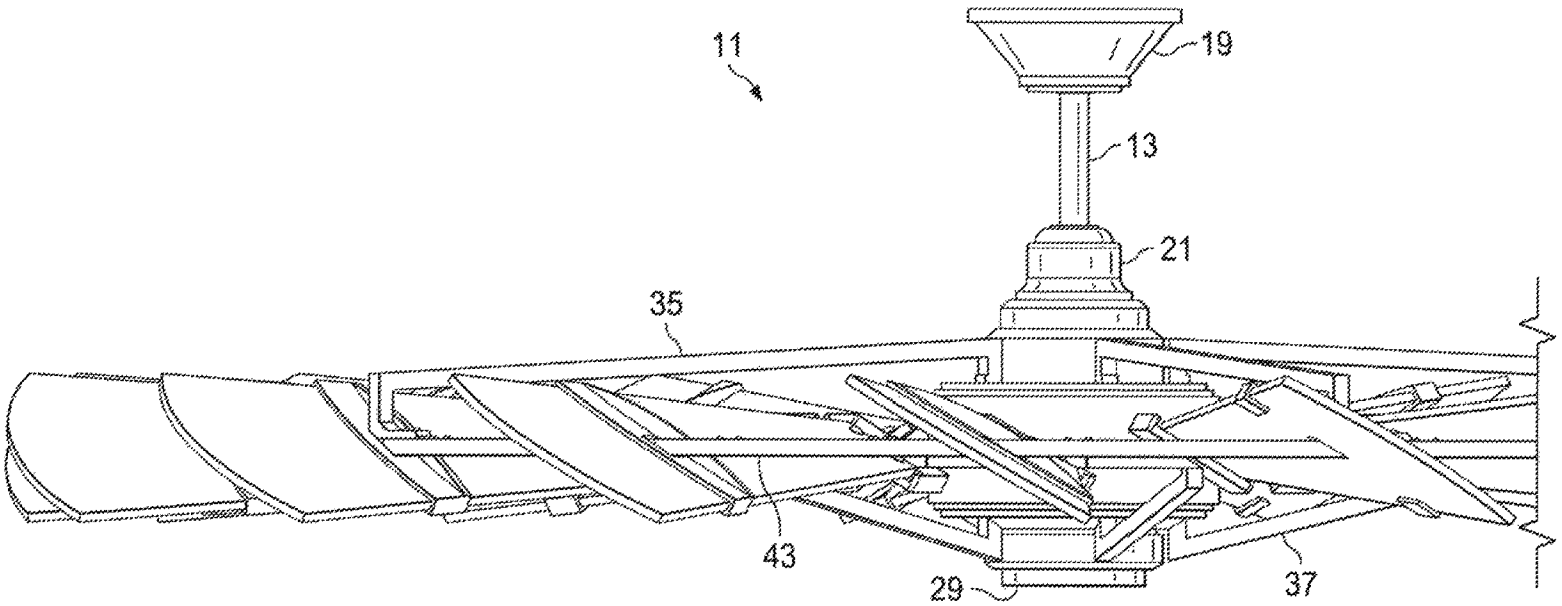
FIG. 2 is a partial, side view of a windmill ceiling fan of the invention showing the upper and lower support antis which support the inner and outer blade support rings.

FIGS. 1 and 2 of the drawings are perspective views taken from the bottom and side, respectively, of a windmill style electric ceiling fan of the invention, the fan being again designated generally as 11. As has been mentioned, these fans present the beauty and durability of the traditional windmill, while being installed like a standard ceiling fan.

As has been briefly described with respect to FIG. 6, a hanger down rod 13 is suspended from the ceiling by a mounting which is concealed by the canopy 19. The down rod 13 connects to the yoke 21. The fan motor is suspended from the yoke 21 by an upper motor shaft (23 in FIG. 6). The upper motor shaft 23 supports the motor body 25 within the motor housing 33, as has been described with respect to FIG. 6. All of the above features are common to a large variety of conventional ceiling fans sold in the marketplace today. Also, as has been described with respect to FIG. 5, in the case of an ordinary ceiling fan, blade mounting irons 24 normally connect to the motor body 20 and extend out of an opening in the bottom of the motor housing 22. The fan blades 26 are attached to the blade irons 24 below the motor housing 22.

However, as briefly mentioned, the windmill ceiling fan has peculiar aspects which require features not found in conventional ceiling fans. The windmill ceiling fan 11 of the invention features a unique mounting assembly for the windmill fan blades. The unique blade mounting assembly includes a series of upper and lower blade support arms (35, 37 respectively in FIGS. 1 and 2) which extend out of openings at the top and bottom of the motor housing 33. As explained with reference to FIG. 6, the upper and lower blade support arms 35, 37 attach to the motor arm bracket 31 which rotates as the motor body 25 rotates. As perhaps best seen in FIG. 4, each of the windmill fan blades 59 is formed as a longitudinal planar body between inner and outer extents 38, 39. Each blade has a peripheral edge region 41 which defines the inner and outer extents of the planar body.

Figure 3:
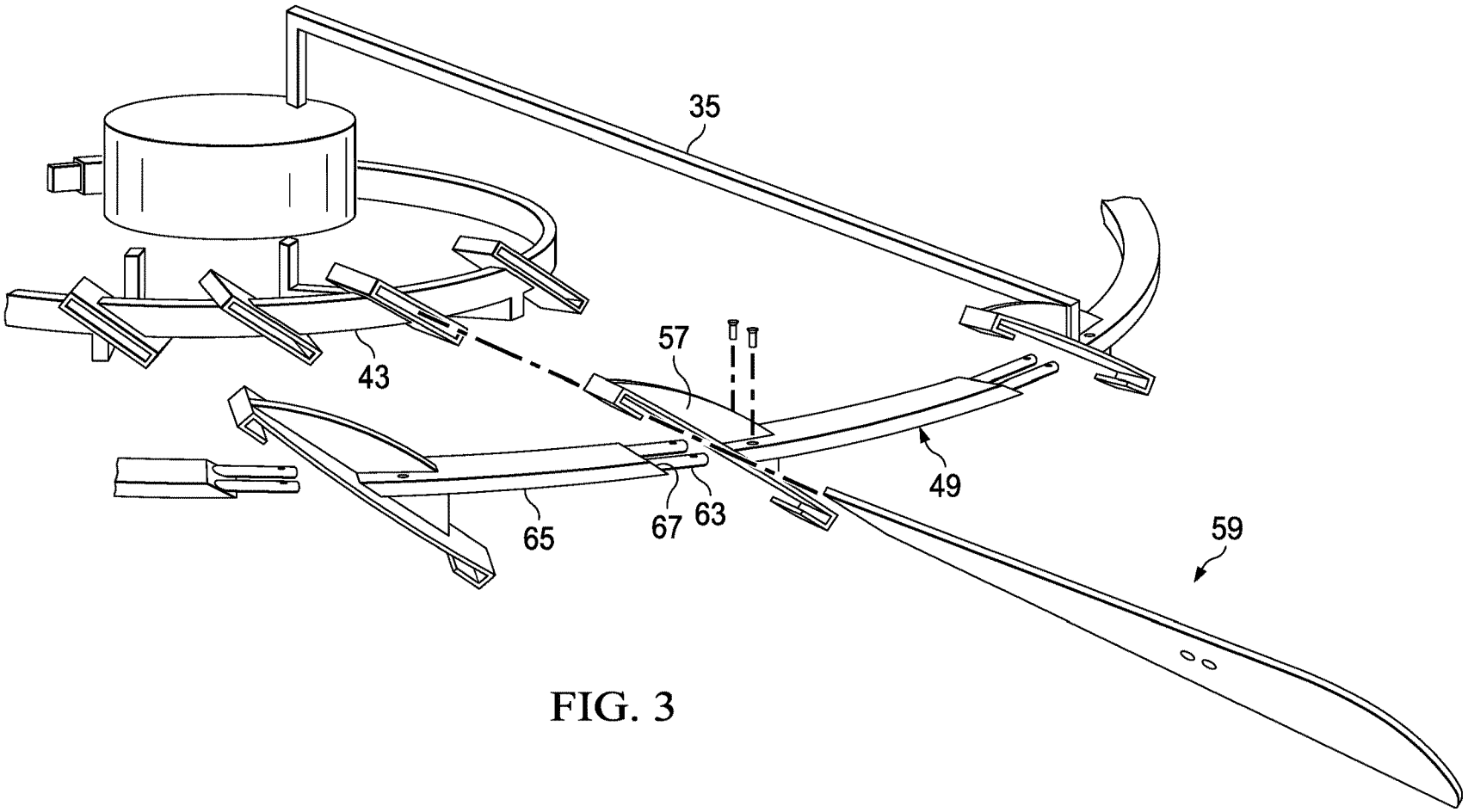
FIG. 3 is a partially schematic, simplified view of portions of the inner and outer blade support rings and one fan blade shown in exploded fashion.
Figure 4:
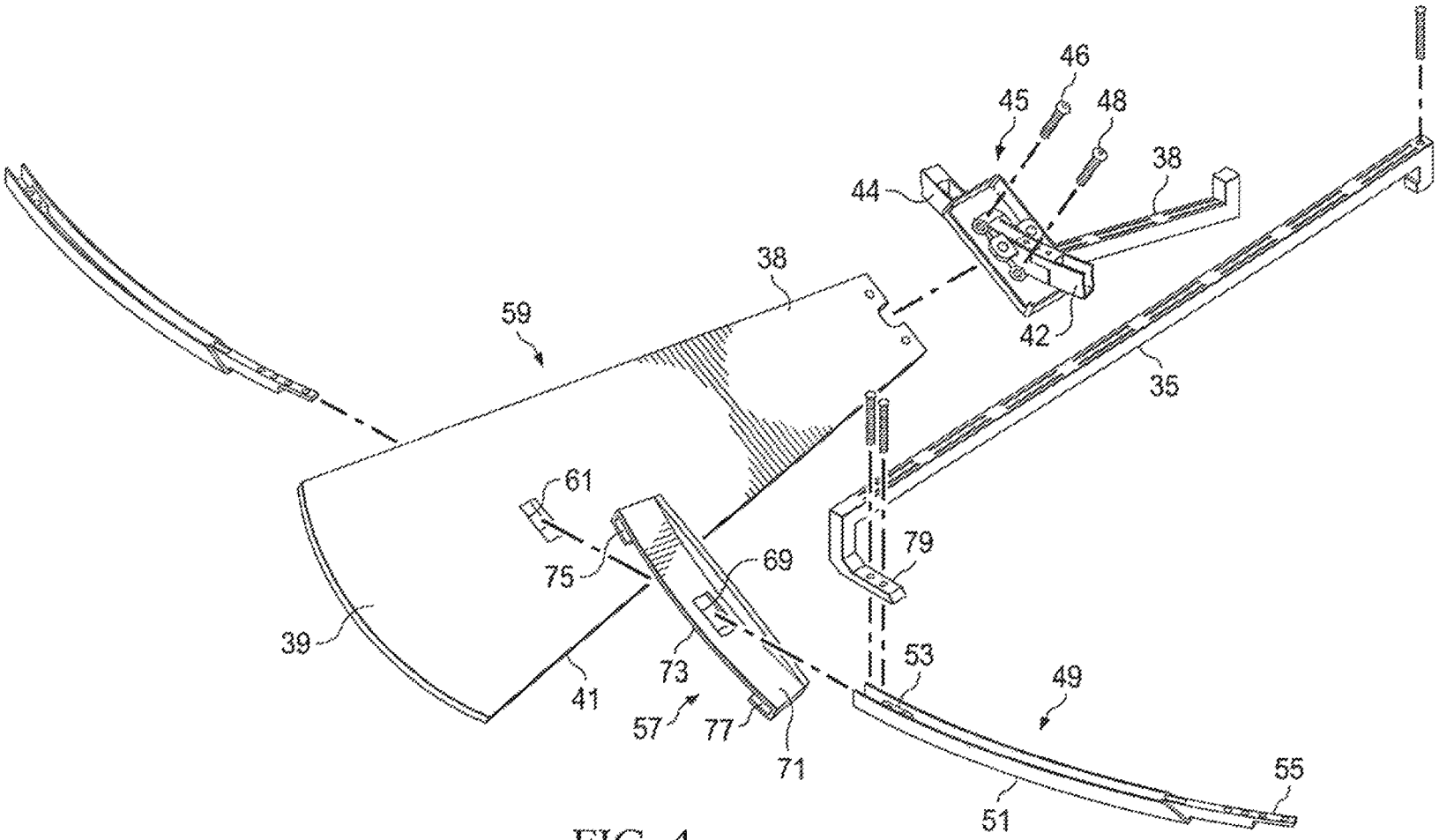
FIG. 4 is a similar view, from a different angle, of one of the fan blades with portions of the inner and outer support rings being shown in exploded fashion and showing more detail of one form of the connections used in the assembly thereof.

As will be appreciated from FIGS. 1 and 2, an inner support ring 43 is used to support the inner blade extents 38. The inner support ring is preferably formed as a plurality of ring segments which are preassembled at the factory so that the ring is fully assembled out of the shipment box. FIG. 3 is a simplified view of the inner ring 43 in the assembled condition. However, FIG. 4 shows more of the detail of the ring segments, two of the ring segments being shown as 42 and 44. They are provided with mating male and female connector ends which allow the segments to be assembled to form a solid ring. As shown in FIG. 4, the inner support ring 43 is secured to the motor body by the series of lower support arms 37. The inner support ring 43 has a series of blade receiving pockets, such as pocket 45 in FIG. 1, formed about a periphery thereof for receiving an inner extent 38 of a fan blade to be supported in the completed assembly. FIG. 4 shows the connecting bolts 46, 48 used to secure the fan blade to the pocket 45.

A relatively larger diameter outer support ring (47 in FIG. 1) is used to provide additional support for the fan blades. One feature of the fan design of the invention is the fact that the outer support ring 47 is also formed as a series of separable segments which are interlockable in use to form a completed solid ring. The outer support ring 47 is secured to the motor body (25 in FIG. 6) by the series of upper support arms (35 in FIGS. 1 and 2).

FIGS. 3 and 4 illustrate the separable and interlockable nature of the outer support ring segments in greater detail. As will be appreciated from the drawings, each of the outer support ring segments (such as segment 49 in FIG. 4) includes an arcuate ring portion 51 of a predetermined length, with a female connector 53 at one extent and a mating male connector 55 at an opposite extent thereof. At least selected ones of the outer ring segments 49 carrying a gusset 57 which receives a portion of a fan blade for further supporting the fan blade.

The male and female connectors can assume various forms. In the version of the design shown in the drawings, the connectors 53, 55 can assume a sort of mortise block and tenon tongue arrangement, as shown in FIG. 3, or more of a tongue and groove connection, as shown in FIG. 4, when assembled together to form the completed outer ring. In other words, the male connector or tenon, formed on the end of the segment, is inserted into an appropriately shaped opening or groove in the next adjacent segment making up the outer ring corresponding member. FIG. 4 shows more detail of one preferred connector arrangement for the inner and outer support rings of the blade mounting assembly. Each blade 59 has at least one opening 61 in the planar body between the inner and outer extents 38, 39 thereof with a portion of the outer support ring segments passing through the opening 61 to further support the fan blades in the completed assembly. In the assembly of FIG. 3, the male, tenon end 63 of the segment 65 passes through the opening 61 in the fan blade 59 with the shoulder region 67 fitting flush against the lower planar surface of the blade 59.

Each of the outer ring segments also passes through an opening 69 provided in the associated gusset (57 in FIG. 4) which holds one of the respective fan blades in place. As can be seen in FIG. 4, the opening 69 in the gusset 57 is alignable with a respective opening 61 provided in the planar body of the fan blade between the inner and outer extents thereof. As also perhaps best seen in FIG. 4, each gusset 57 comprises a sleeve having an upper surface 71, a lower surface 73, and opposing turned-in pockets 75, 77. The opposing turned-in pockets 75, 77 each receive a portion of the peripheral edge region 41 of a respective fan blade being supported in the completed assembly. At least selected ones of the upper support arms 35 are connected at one end to the fan motor body (through the motor arm brackets 31 in FIG. 6) and at an opposite end 79 to one of the outer ring segments 49. In similar fashion, at least selected ones of the lower support arms (37 in FIGS. 1 and 4) are connected at one end to the fan motor body (through the motor arm brackets) and at an opposite end to one of the series of blade receiving pockets (45 in FIG. 1) carried on the inner ring 43.

The previously described fan blade assembly can be used to assembly a completed windmill ceiling fan, as shown in FIGS. 1 and 2. The method of assembling a windmill ceiling fan using a blade mounting assembly of the invention includes providing an inner support ring; securing the inner support ring to the motor body by a series of lower support arms, the inner support ring having a series of blade receiving pockets formed about a periphery thereof for receiving an inner extent of a fan blade to be supported; providing an outer support ring formed as a series of separable segments which are interlockable in use to form a completed solid ring; assembling the outer ring by interlocking the series of separable segments and securing the outer support ring to the motor body by a series of upper support arms; and wherein each of the outer support ring segments includes an arcuate ring portion of a predetermined length, with a female connector at one extent and a mating male connector at an opposite extent thereof, the female and mating male connectors being engaged in forming the assembled outer support ring, at least selected ones of the outer ring segments carrying a gusset which receives a portion of a fan blade for further supporting the fan blade.

An invention has been provided with several advantages. The windmill style ceiling fan of the invention provides a touch of nostalgia to either indoor or outdoor living areas reminiscent of farm and ranch windmills of yore. These fans present the beauty and durability of the traditional windmill, while installing like a standard ceiling fan. They make attractive interior or exterior placements using standard electrical service. As mentioned, special ceiling supports are generally not required. They can conveniently be hung, for example, in a cathedral ceiling, urban loft, great room, or outdoor kitchen/patio, to provide a pleasing esthetic effect. Because the blade structure of the windmill style fan is much larger and more massive in size than the typical home electric ceiling fan, a special blade mounting assembly is utilized. The mounting assembly includes inner and outer modular support rings. At least the larger diameter outer support ring is made up of separable and interlockable segments, allowing it to be broken down for shipment. The mounting assembly also includes both upper and lower support arms extending outwardly from the fan motor to provide the support and stability needed for supporting the windmill style blade structure.

It should also be understood that the foregoing relates to preferred embodiments of the present invention and that numerous changes may be made therein without departing from the scope of the invention. The invention is further illustrated by the examples contained herein, which are not to be construed in any way as imposing limitations upon the scope thereof. On the contrary, it is to be clearly understood that resort may be had to various other embodiments, modifications, and equivalents thereof, which, after reading the description herein, may suggest themselves to those skilled in the art without departing from the spirit of the present invention and/or the scope of the appended claims.

What is claimed is:

1. A blade mounting assembly for producing a completed windmill ceiling fan having a plurality of blades formed as longitudinal planar bodies between inner and outer extents thereof, the ceiling fan having a ceiling fan motor with a motor body that rotates about a motor shaft, the blade mounting assembly comprising:

an inner support ring, the inner ring being secured to the motor body by a series of lower support arms, the inner support ring having a series of blade receiving pockets formed about a periphery thereof for receiving an inner extent of a fan blade to be supported in the completed assembly;

an outer support ring formed as a series of separable segments which are interlockable in use to form a completed solid ring, the outer support ring being secured to the motor body by a series of upper support arms; and wherein each of the outer support ring segments includes an arcuate ring portion of a predetermined length, with a female connector at one extent and a mating male connector at an opposite extent thereof, at least selected ones of the outer ring segments carrying a gusset which receives a portion of a fan blade for further supporting the fan blade, whereby each fan blade is supported at two points, to the blade receiving pockets on the inner support ring and to the gussets on the outer support ring.

2. The blade mounting assembly of claim 1, wherein each blade has at least one opening in the planar body between the inner and outer extents thereof with a portion of the outer support ring segments passing through the opening to further support the fan blades in the completed assembly.

3. The blade mounting assembly of claim 2, wherein the female connector at one extent of each outer support ring segment and the mating male connector at the opposite extent thereof comprise a type of mortise block and tenon tongue or tongue and groove connectors when assembled together to form the completed outer ring.

4. The blade mounting assembly of claim 3, wherein each of the outer ring segments also passes through an opening provided in the associated gusset which holds one of the respective fan blades in place, the opening in the gusset being alignable with a respective opening provided in the planar body of the fan blade between the inner and outer extents thereof.

5. The blade mounting assembly of claim 4, wherein each of the fan blades has a peripheral edge region which defines the inner and outer extents of the planar body thereof, and wherein each gusset comprises a sleeve having an upper surface, a lower surface, and opposing turned-in pockets, the opposing turned-in pockets each receiving a portion of the peripheral edge region of a respective fan blade being supported in the completed assembly.

6. The blade mounting assembly of claim 5, wherein at least selected ones of the upper support arms are connected at one end to the fan motor body and at an opposite end to the outer support ring.

7. The blade mounting assembly of claim 6, wherein at least selected ones of the lower support arms are connected at one end to the fan motor body and at an opposite end to one of the series of blade receiving pockets carried on the inner ring.

8. A windmill ceiling fan assembly, comprising:

a ceiling fan having a fan motor with a motor body that rotates about a motor shaft;

a plurality of fan blades rotatably mounted on the motor body by a blade mounting assembly for rotation therewith, each of the blades being formed as a longitudinal planar body between inner and outer extents thereof, each blade having an upper planar surface, a lower planar surface and a peripheral edge region which defines the inner and outer extents of the planar body thereof;

wherein the blade mounting assembly includes an inner support ring, the inner ring being secured to the motor body by a series of lower support arms, the inner support ring having a series of blade receiving pockets formed about a periphery thereof for receiving an inner extent of a fan blade to be supported in the completed fan assembly;

the blade mounting assembly also including an outer support ring formed as a series of separable segments which are interlockable in use to form a completed solid ring, the outer support ring being secured to the motor body by a series of upper support arms;

wherein each of the outer support ring segments includes an arcuate ring portion of a predetermined length, with a female connector at one extent and a mating male connector at an opposite extent thereof, at least selected ones of the outer ring segments carrying a gusset which receives a portion of a fan blade for further supporting the fan blade, whereby each fan blade is supported at two points, to the blade receiving pockets on the inner support ring and to the gussets on the outer support ring.

9. The windmill ceiling fan assembly of claim 8, wherein each blade has at least one opening in the planar body between the inner and outer extents thereof with a portion of the outer support ring segments passing through the opening to further support the fan blades in the completed assembly.

10. The windmill ceiling fan assembly of claim 9, wherein the female connector at one extent of each outer support ring segment and the mating male connector at the opposite extent thereof comprise a type of mortise block and tenon tongue or tongue and groove connectors when assembled together to form the completed outer ring.

11. The windmill ceiling fan assembly of claim 10, wherein each of the outer ring segments also passes through an opening provided in the associated gusset which holds one of the respective fan blades in place, the opening in the gusset being alignable with a respective opening provided in the planar body of the fan blade between the inner and outer extents thereof.

12. The windmill ceiling fan assembly of claim 11, wherein each of the fan blades has a peripheral edge region which defines the inner and outer extents of the planar body thereof, and wherein each gusset comprises a sleeve having an upper surface, a lower surface, and opposing turned-in pockets, the opposing turned-in pockets each receiving a portion of the peripheral edge region of a respective fan blade being supported in the completed assembly.

13. The windmill ceiling fan assembly of claim 12, wherein at least selected ones of the upper support arms are connected at one end to the fan motor body and at an opposite end to the outer support ring.

14. The windmill ceiling fan assembly of claim 13, wherein at least selected ones of the lower support arms are connected at one end to the fan motor body and at an opposite end to one of the series of blade receiving pockets carried on the inner ring.

15. A method of assembling a windmill ceiling fan using a blade mounting assembly where the completed ceiling fan has a plurality of blades formed as longitudinal planar bodies between inner and outer extents thereof, the completed ceiling fan also having a ceiling fan motor with a motor body that rotates about a motor shaft, the method comprising the steps of:

providing an inner support ring;

securing the inner support ring to the motor body by a series of lower support arms, the inner support ring having a series of blade receiving pockets formed about a periphery thereof for receiving an inner extent of a fan blade to be supported;

providing an outer support ring formed as a series of separable segments which are interlockable in use to form a completed solid ring;

assembling the outer ring by interlocking the series of separable segments and securing the outer support ring to the motor body by a series of upper support arms; and wherein each of the outer support ring segments includes an arcuate ring portion of a predetermined length, with a female connector at one extent and a mating male connector at an opposite extent thereof, the female and mating male connectors being engaged in forming the assembled outer support ring, at least selected ones of the outer ring segments carrying a gusset which receives a portion of a fan blade for further supporting the fan blade.

16. The method of assembling a windmill ceiling fan of claim 15, further comprising the steps of:

providing each blade with at least one opening in the planar body between the inner and outer extents thereof and passing a portion of one of the respective outer support ring segments through the opening to further support the fan blades.

17. The method of assembling a windmill fan of claim 16, wherein each of the outer ring segments is also passed through an opening provided in the associated gusset which holds one of the respective fan blades in place, the opening in the gusset being alignable with a respective opening provided in the planar body of the fan blade between the inner and outer extents thereof.

18. The method of assembling a windmill fan of claim 17, wherein each of the fan blades has a peripheral edge region which defines the inner and outer extents of the planar body thereof, and wherein each gusset comprises a sleeve having an upper surface, a lower surface, and opposing turned-in pockets, the opposing turned-in pockets each receiving a portion of the peripheral edge region of a respective fan blade being supported.

19. The method of assembling a windmill fan of claim 18, wherein at least selected ones of the upper support arms are connected at one end to the fan motor body and at an opposite end to the outer support ring.

20. The method of assembling a windmill fan of claim 19, wherein at least selected ones of the lower support arms are connected at one end to the fan motor body and at an opposite end to one of the series of blade receiving pockets carried on the inner ring.

* * * * *